US008783551B2

(12) United States Patent
McClure

(10) Patent No.: US 8,783,551 B2
(45) Date of Patent: Jul. 22, 2014

(54) HAMMER-LOCK CONTAINER

(75) Inventor: Jack A. McClure, Omaha, NE (US)

(73) Assignee: International Paper Co., Memphis, TN (US)

( * ) Notice: Subject to any disclaimer, the term of this patent is extended or adjusted under 35 U.S.C. 154(b) by 263 days.

(21) Appl. No.: 13/091,379

(22) Filed: Apr. 21, 2011

(65) Prior Publication Data

US 2011/0259899 A1 Oct. 27, 2011

Related U.S. Application Data

(60) Provisional application No. 61/328,446, filed on Apr. 27, 2010.

(51) Int. Cl.

*B65D 5/30* (2006.01)
*B65D 5/66* (2006.01)
*B65D 5/00* (2006.01)

(52) U.S. Cl.

CPC ..... *B65D 5/003* (2013.01); *B65D 5/6652* (2013.01); *B65D 5/6658* (2013.01)
USPC ..... 229/143; 229/131; 229/147; 229/150; 229/154

(58) Field of Classification Search

USPC ..... 229/131, 143, 150, 152, 154, 151, 153, 229/170, 174, 178, 147
See application file for complete search history.

(56) References Cited

U.S. PATENT DOCUMENTS

| | | | | |
|---|---|---|---|---|
| 1,192,168 A | | 7/1916 | Cook | |
| 1,302,361 A | * | 4/1919 | Gordon | 229/143 |
| 1,383,148 A | | 6/1921 | Pinkerton | |
| 1,525,360 A | | 2/1925 | Blandford | |
| 1,530,644 A | * | 3/1925 | Blandford | 229/148 |
| 1,791,196 A | * | 2/1931 | Deutschmeister | 206/232 |
| 1,824,927 A | * | 9/1931 | Powell | 229/150 |
| 1,869,724 A | * | 8/1932 | Wallace | 229/146 |
| 1,895,070 A | * | 1/1933 | Czerweny | 229/131 |
| 2,308,818 A | * | 1/1943 | Levkoff | 229/167 |
| 2,938,623 A | * | 5/1960 | Eichorn | 206/425 |
| 2,942,770 A | * | 6/1960 | Eichorn | 229/101 |
| 3,010,635 A | | 11/1961 | Sheldon-Williams | |
| 3,088,651 A | | 5/1963 | Rasmusson | |

(Continued)

FOREIGN PATENT DOCUMENTS

| | | |
|---|---|---|
| AU | 2009100873 | 10/2009 |
| DE | 202008011370 | 11/2008 |
| FR | 2510970 | 2/1983 |
| WO | 2008084183 | 7/2008 |

*Primary Examiner* — Gary Elkins
*Assistant Examiner* — Scott McNurlen
(74) *Attorney, Agent, or Firm* — Matthew M. Eslami

(57) ABSTRACT

A container is formed from a one-piece unitary blank of material in which the container comprises a bottom wall foldably joined to upstanding opposed parallel side walls, a back wall, and a front wall. A top wall is foldably joined to the back wall. The bottom wall comprises at least first and second slots each of which are formed on opposed lateral edges in proximity of the front wall. A first shoulder panel is foldably joined to a longitudinal edge of the front wall. The first shoulder panel includes respective first and second hammer-lock flaps each of which is foldably joined from opposed lateral edges. Each of the respective first and second hammer-lock flaps includes respective first and second locking tabs extending outwardly from respective free edges and is inserted into the corresponding first and second slots on the bottom wall.

11 Claims, 20 Drawing Sheets

(56) References Cited

U.S. PATENT DOCUMENTS

| | | | | |
|---|---|---|---|---|
| 3,385,424 | A | | 5/1968 | Thompson et al. |
| 3,395,850 | A | | 8/1968 | Kotowick |
| 3,581,976 | A | | 6/1971 | Burgess |
| 3,801,000 | A | | 4/1974 | Hurley et al. |
| 3,889,868 | A | | 6/1975 | Bruckner et al. |
| 4,168,028 | A | | 9/1979 | McCall |
| 4,197,980 | A | | 4/1980 | Johnson |
| 4,375,263 | A | * | 3/1983 | Dworkin ..... 206/425 |
| 4,436,206 | A | | 3/1984 | Kuchenbecker |
| 4,537,344 | A | * | 8/1985 | Thomas ..... 229/169 |
| 4,620,666 | A | | 11/1986 | Lacasa et al. |
| 4,702,409 | A | * | 10/1987 | Osborne ..... 229/125 |
| 4,844,331 | A | | 7/1989 | Oldfather |
| 5,139,195 | A | | 8/1992 | McClure |
| 6,032,853 | A | * | 3/2000 | Chevalier ..... 229/125.37 |
| 6,840,437 | B2 | | 1/2005 | Chen |
| 7,234,629 | B2 | | 6/2007 | Ho |

* cited by examiner

HAMMER-LOCK CONTAINER

CROSS REFERENCE TO RELATED APPLICATIONS

This application claims priority to U.S. provisional patent application Ser. No. 61/328,446, filed on 27 Apr. 2010, which is hereby incorporated hereinto by reference as if fully restated herein.

FIELD OF THE INVENTION

The present invention relates generally to a shipping container formed from a one-piece unitary blank of material, and more particularly, to a front-rollover-style shipping container having self-locking features and a tray style depth and requires no specialized equipment for assembly.

BACKGROUND OF THE INVENTION

It is a common practice in meat or poultry industry to pack their meat or poultry patty in a paperboard container. Previously, the corrugated paperboard grade was reduced on a One-piece Front-Rollover-Style meat or poultry patty container or tray to the point that it was failing across the back of the container, and also at the back of the cover plate. To solve this problem without increasing the cost, the alternative containers or trays had to be stronger across the back side. The Front-Rollover-Style container up until now had the smallest blank size for shallow-size hand-set container and rapid hand-set-up, which have been its strength. However, this container has drawbacks such as the long-corrugated blank size gives fewer trim options off of the corrugators, and that it was about twice as strong across the front of the container as it was across its back. This drawback causes problems in containers or trays column-stacked on a pallet, where the strong front of the bottom container serves as fulcrum point, and the stack will progressively tip toward the weak side, with undesirable results.

Therefore, it is desirable to provide a front-rollover-style shipping container having self-locking features and a tray style depth which can be easily manufactured on standard manufacturing and erecting equipment.

SUMMARY OF THE INVENTION

The present invention relates to front-rollover-style shipping container having self-locking features, also known as hammer-lock container. The phrase "Hammer-lock" generally means that due to the structure of the locking feature of the container, it is the hard edge of the hammer-lock panel that makes lock up contact with its matching slot. The hammer-lock container has at least the following advantages: 1) the container has a smaller sized blank, 2) can be quickly and easily set up, 3) the short-corrugation blank size is more adaptable to production, and 4) has balanced higher strength. The hammer-lock feature can be used in number of different ways. For example, it can be used on both sides of a tray or container. In addition, in the one-piece container styles illustrated in the drawings, the dust flap may have ears attached to their ends, which could be inserted between the front and front minor panels.

Some other advantages of the hammer-lock container are: 1) the blank size is reduced at least by 15%, 2) measured compression for the Hammer-lock container is at least 5% greater. However, effective compression is significantly better when you consider that paperboard grade minimums are determined by the weakest element of a Hammer-lock container. In the case of the Front-Rollover-Style container, when fully closed, the front side has three layers of vertical corrugation and one horizontal layer, while the back side of the container has one layer of vertical corrugation and one horizontal layer, which means that the front side of the container has something like double the compression strength as the back side of the container. Therefore, the ⅔, ⅓ split on compression strength that means, in terms of effective compression, that the Front-Rollover-Style container needs a paperboard grade that is half again stronger than the Hammer-Lock style in order to break even in endurance. Summing up these advantages yield a total performance/cost advantage of at least 70% in this particular size example (other sizes will vary as well). Third, from a container-plant-production standpoint, the corrugation direction on the Front-Rollover-Style container is the long dimension of the blank, while the Hammer-lock style container is the short dimension of the blank. This smaller dimension makes the Hammer-lock container easier to trim off of the corrugators. Fourth, there is less blank fall-off at the die cutter for the Hammer-lock container, which typically leads to better runs speeds, not to mention the potential reduction of scrap in the units to which customers take exception.

Several alterations were required to get the container to lockup properly in die cut form. First, the scores at the top and bottom of the front (and, in some cases also the back panel) panels had dog leg kinks added to their extreme ends, to assure that the scores would not roll "out" on their respective score lines and cause a "lifting effect" on the Hammer-lock-carrying flange panel. Second, a kink was added to the bottom-panel score line in front of the lock slot, along with a cut extension of the front of the slot, to encourage that portion of the bottom panel to "lift", thus slightly increasing the amount of interference between the front of the slot and the lock edge of the Hammer-lock. Thirdly, the Lock tabs (plus the End panel) were increased in height to further increase that interference. It took all three of these alterations working in concert to arrive at a container style that consistently locks up to a commercially acceptable level.

Accordingly, the present invention is directed to a container formed from a one-piece unitary blank of material. The container comprises a bottom wall foldably joined to upstanding opposed parallel side walls, a back wall, and a front wall. A top wall is foldably joined to the back wall. The bottom wall comprises at least first and second slots each of which formed on opposed lateral edges in proximity of the front wall. A first shoulder panel is foldably joined to longitudinal edge of the front wall. The first shoulder panel includes respective first and second hammer-lock flaps each of which foldably joined from opposed lateral edges. Each of the respective first and second hammer-lock flaps includes respective first and second locking tabs extends outwardly from respective free edges and is inserted into the corresponding first and second slots on the bottom wall. The bottom wall further includes respective third and fourth slots each of which is formed on the opposed lateral edges in proximity of the back wall. The top wall comprises a pair of opposed dust flaps each of which is foldably joined to respective lateral edges of the top wall. Each of the dust flaps further includes a dust locking tab each of which extends outwardly from respective edges. Each of the dust locking tabs is inserted into the respective third and fourth slots. Alternatively, each of the dust flaps further includes a pair of ear flaps that are configured to bring the back and top walls into juxtaposition with the front and bottom walls, respectfully. The top wall further comprises a fifth locking tab extends outwardly from free edge thereof. The first shoulder panel further includes a fifth slot formed in proximity of mid-portion and adjacent to the front wall to receive the fifth locking tab of the top wall. The container further comprises a second shoulder panel foldably joined to longitudinal edge of the back wall. The second shoulder panel includes respective third and fourth hammer-lock flaps each of which is foldably joined from opposed lateral edges. Each of the third and fourth hammer-lock flaps includes respective third and fourth locking tabs each of which extends outwardly from respective free edges thereof and is inserted into the corresponding third and fourth slots on the bottom wall. Each of the third and fourth hammer-lock flaps is foldably joined to corner of the longitudinal edge of the back wall.

Another aspect of the present invention relates to a container formed from a one-piece unitary blank of material used for shipping a plurality of articles. The container comprises a bottom wall, a front wall, a back wall, and opposite side walls foldably joined to one another to form a shallow tray. The bottom wall comprises at least first and second slots each of which formed on opposed lateral edges in proximity of the front wall. A first shoulder panel is foldably joined to longitudinal edge of the front wall. The first shoulder panel comprises respective first and second hammer-lock flaps each of which is foldably joined from opposed lateral edges thereof. The respective first and second hammer-lock flaps includes respective first and second locking tabs extend outwardly from respective free edges thereof and is inserted into the corresponding first and second slots on the bottom wall.

Another further aspect of the present invention relates to one-piece unitary blank for making a container used for shipping a plurality of articles. The blank comprises a bottom wall panel having a front edge, a back edge, and opposite side edges defined by respective transverse and longitudinal fold lines. The bottom wall comprises at least first and second slots each of which is formed on opposed side edges. A top wall panel comprises a front edge, a back edge, and opposite side edges defined by respective transverse and longitudinal fold lines. A back wall panel is foldably joined between the back edges of the bottom wall panel and the top wall panel. A front wall panel comprises a front edge, a back edge, and opposite side edges in which the back edge of the front wall is foldably joined to the bottom wall panel. A first shoulder panel is foldably joined to the front edge of the front wall, which the first shoulder panel comprises respective first and second hammer-lock flaps each of which is foldably joined from opposed lateral edges and is configured to be inserted into the respective first and second slots when the blank is folded for making the container. The bottom wall panel further includes respective third and fourth slots each of which is formed on the opposed side edges in proximity of the back wall.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
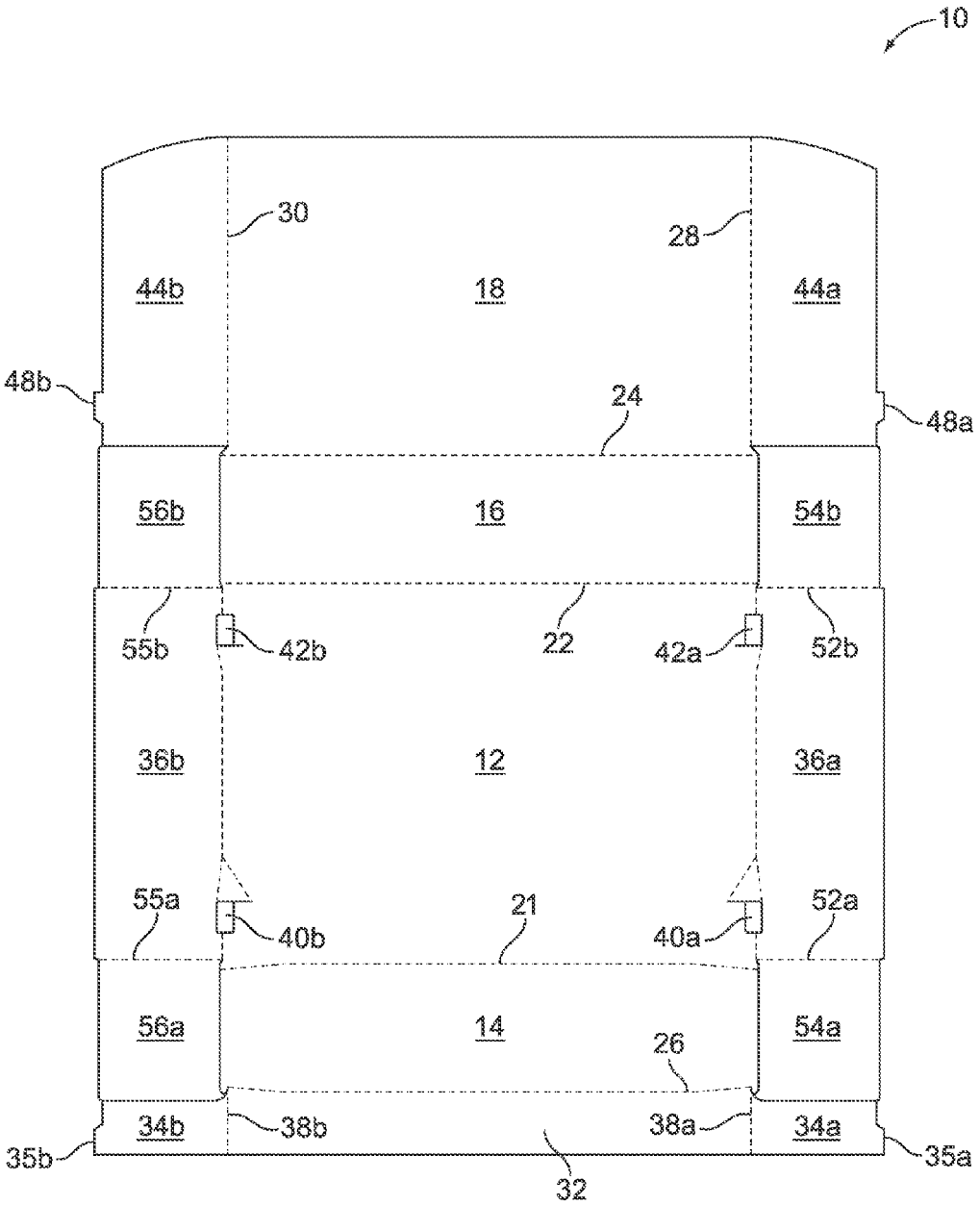
FIGS. 1 and 2 are the respective plan view and top perspective view of a cut and scored paperboard blank for forming a hammer-lock container depicted in FIGS. 3A-3E in accordance to a first embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same. In addition, the phrase "Hammer-lock" generally means that due to the structure of the locking feature of the container, it is the hard edge of the hammer-lock panel that makes lock up contact with its matching slot.

Figure 2:
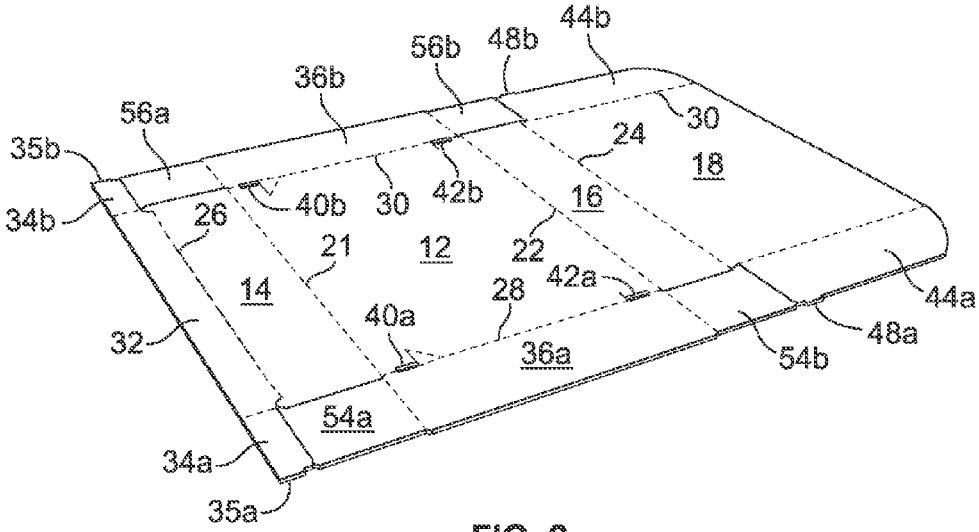

FIGS. 1 and 2 are the respective plan view and top perspective view of a cut and scored paperboard blank for forming a hammer-lock container depicted in FIGS. 3A-3E in accordance to a first embodiment of the present invention. The blank 10 is substantially flat symmetrical with respect to its longitudinal axis thereof. The blank 10 is preferably an integral piece of a material such as continuous sheet of conventional corrugated cardboard. The blank 10 is cut along its outer margins to form its specific shape. The blank 10 is divided into front wall panel 14, side wall panels 36*a*, 36*b*, bottom wall panel 12, back wall panel 16 panels and an optional top wall panel 18 by three transverse parallel fold lines 21, 22, and 24. The blank 10 is further divided by two longitudinal parallel fold lines 28, 30. The bottom wall panel 12 comprises a front edge, a back edge, and opposite side edges defined by respective transverse and longitudinal fold lines 21, 22, 24, 28, and 30. Although the blank 10 is characterized as having side panels and end panels, but one of the ordinary skilled in the art would appreciate that the end panels can be defined as side panels as well and the characterization of the side panels and end panels have no effect on the function or utility of the blank 10. The front wall panel 14 is defined by fold line 21. A front wall panel 14 comprises a front edge, a back edge, and opposite side edges in which the back edge of the front wall is foldably joined to the bottom wall panel. The bottom wall panel 12 is defined by fold lines 21, 22. The back wall panel 16 is defined by fold lines 22, 24 and the top wall panel 18 is defined by fold line 24. The bottom wall panel 12 and top wall panel 18 are spaced apart from one another by the back wall panel 16. The front wall panel 14 includes a first shoulder panel 32 defined by fold line 26. The first shoulder panel 32 is foldably joined to the front edge of the front wall panel 14. The first shoulder panel 32 further includes first and second hammer-lock flaps 34*a*, 34*b* defined by two respective fold lines 38*a*, 38*b*, and each of which extends from the lateral side of the shoulder panel 32. Each of the hammer-lock flaps 34*a*, 34*b* includes a respective first and second locking tab 35*a*, 35*b* at its respective free edge. Two opposed parallel side panels 36*a*, 36*b* are defined by respective fold lines 28, 30 and integrally extend from the respective lateral side of the bottom panel 12. Each of the opposed side panels 36*a*, 36*b* includes corresponding first and second flanges 54*a*, 54*b*, third and fourth flanges 56*a*, 56*b* each of which extend from the respective lateral sides thereof. The first, second flanges 54*a*, 54*b* and third, fourth flanges 56*a*, 56*b* are defined by respective fold lines 52*a*, 52*b* and 55*a*, 55*b*. The bottom wall panel 12 includes first, second slots 40*a*, 40*b* and third, fourth slots 42*a*, 42*b* formed substantially on the lateral edge near the respective fold lines 28 and 30. The respective first and second slots 40*a*, 40*b* is formed on the opposed side edges thereof in proximity of the front wall panel 14 and third and fourth slots 42*a*, 42*b* each of which is formed on the opposed side edges thereof in proximity of the back wall 16. The top wall panel 18 includes two identical dust flaps 44*a* and 44*b* defined by fold lines 28, 30 and extend from its lateral edge. Each of the dust flaps 44*a*, 44*b* includes a respective dust lock tab 48*a*, 48*b* formed at its respective free edge. When the blank 10 is in folded position, the dust locking tab 48*a*, 48*b* are inserted into the slots 42*a*, 42*b*. Similarly, the respective first and second locking tabs 35*a*, 35*b* are inserted to corresponding slots 40*a*, 40*b*.

FIGS. 3A through 3E illustrate the folding sequences of the blank shown in FIG. 2 for constructing the hammer-lock container 20 in accordance with the first embodiment of the present invention. It should be noted that the proper size and configuration (e.g., proportion) of these panels are important to construct into front, bottom, back, and top wall panels that are brought into juxtaposition with one another to form the hammer-lock container 20 as particularly depicted in FIGS. 3D & 3E.

Figure 3A:
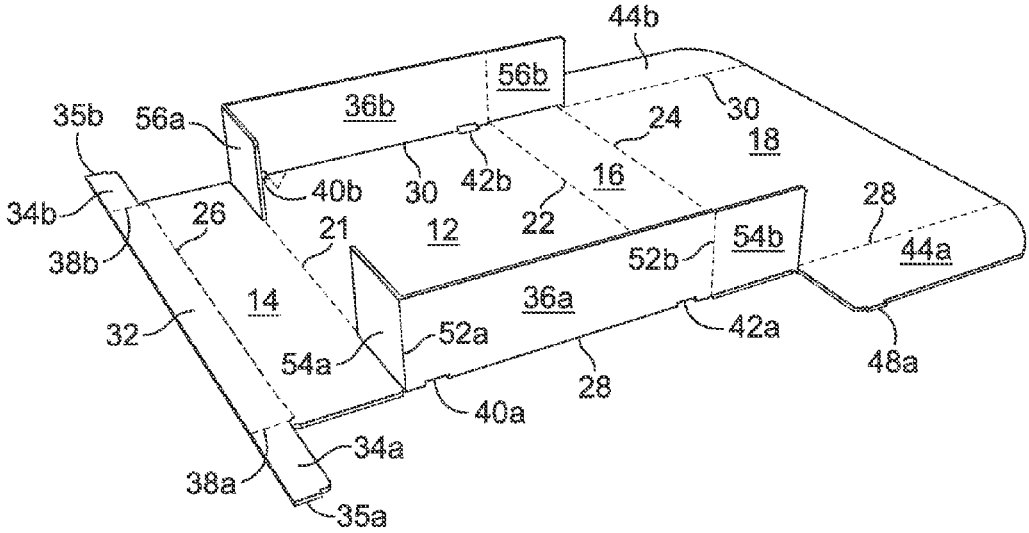
FIGS. 3A-3E illustrate the folding sequences of the blank shown in FIG. 2 for constructing the hammer-lock container in accordance to the first embodiment of the present invention.
Figure 3B:
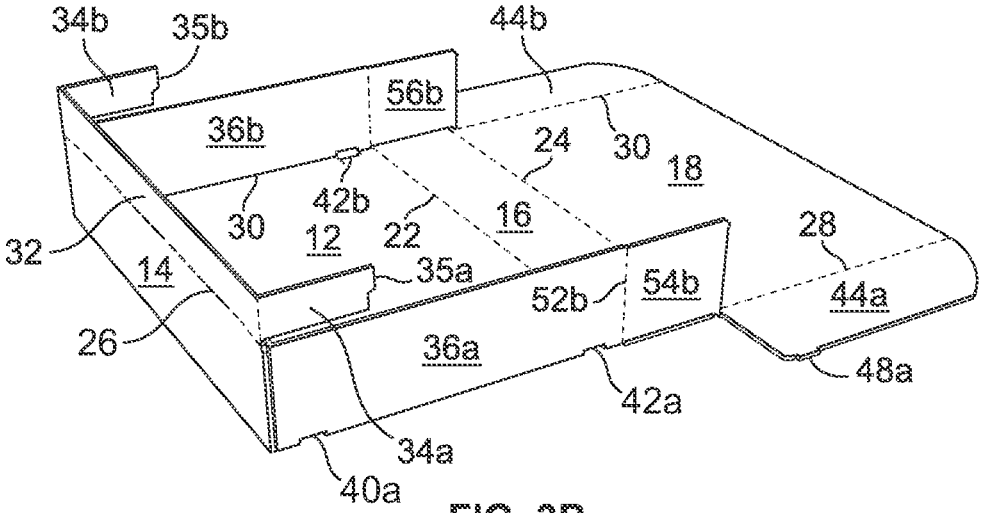
Figure 3C:
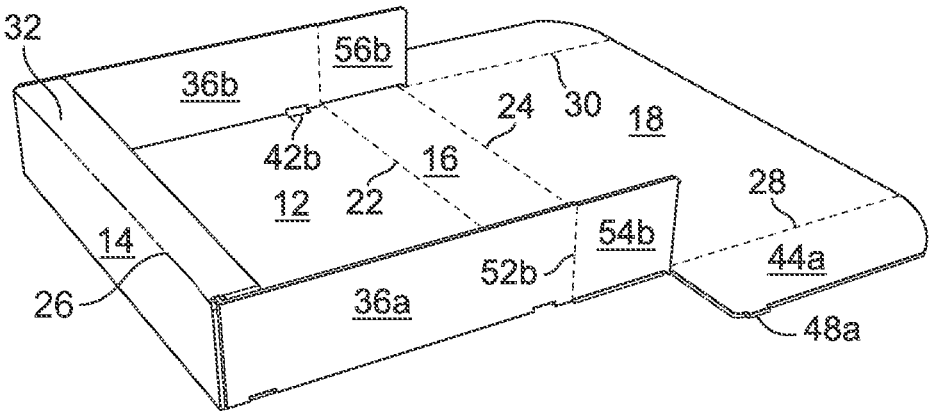
Figure 3D:
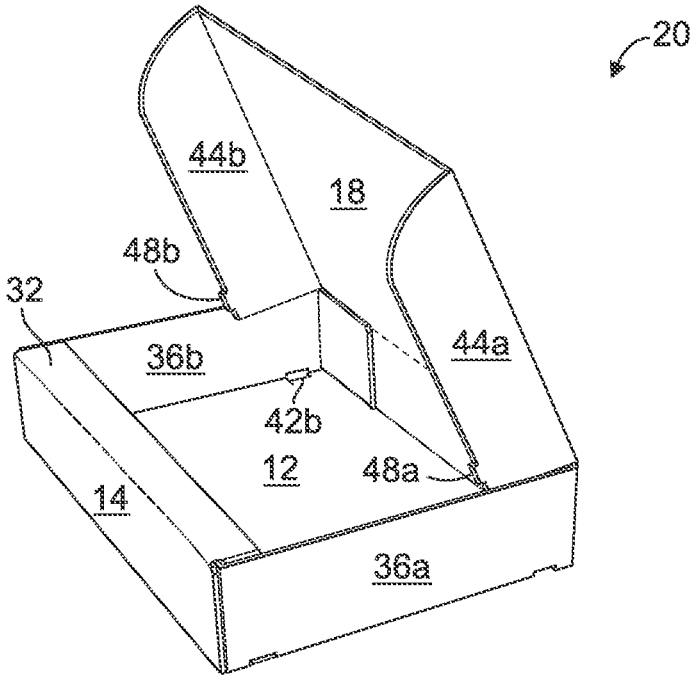
Figure 3E:
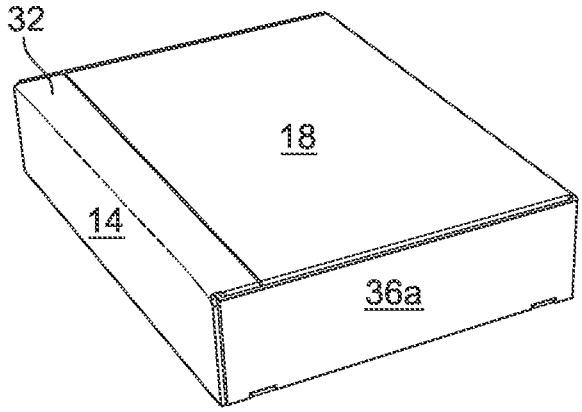

Referring to FIGS. 3A-3E, manual set-up of the hammer-lock container 20 is easily accomplished. However, an ordinary skilled in the art would appreciate that generally a folding machine alternatively performs the forming operations. The blank 10 is laid horizontally; the side wall panels 36*a*, 36*b* are folded upright along respective fold lines 28 and 30 to form the side walls 36*a*, 36*b*. Next, the two flanges 54*a*, 56*a* are folded toward one another at right angle with respect to fold lines 52*a*, 55*a*. Next, front wall panel 14 is folded upright with respect to fold line 21 and the first and second hammer-lock flaps 34*a*, 34*b* are folded at right angle in embracing manner and pushed downwardly so that the first and second locking tabs 35*a*, 35*b* are securely inserted into the corresponding first and second slots 40*a*, 40*b* as depicted in FIGS. 3B and 3C. It should be noted that the first shoulder panel 32 provides a landing surface when the hammer-lock flaps 34*a*, 34*b* are in folded position. The first shoulder panel 32 provides significant support to the hammer-lock container 20 when these containers are stacked up on one another. Next, the two flanges 54*b*, 56*b* are folded toward one another at right angle with respect to fold lines 52*b*, 55*b* and the back wall panel 16 is folded upright with respect to fold line 24. Next, the dust flaps 44*a*, 44*b* are folded uprightly along the respective fold lines 28, 30 as the top wall panel 18 encloses the hammer-lock container 20 when the first and second hammer-lock tabs 48*a*, 48*b* are inserted into the slot respective first and second 42*a*, 42*b*. It should be noted that the free edge of the top wall panel 18 is aligned with the free edge of the shoulder panel 32 such that the top portion of the hammer-lock container 20 is securely enclosed. In use, the hammer-lock container 20 may contain variety of products, but not limited to, such as hamburger patties, electronic devices, condiments and/or produce since the container 20 has superior stackability when compared to prior art containers for similar goods and/or functions.

Figure 4:
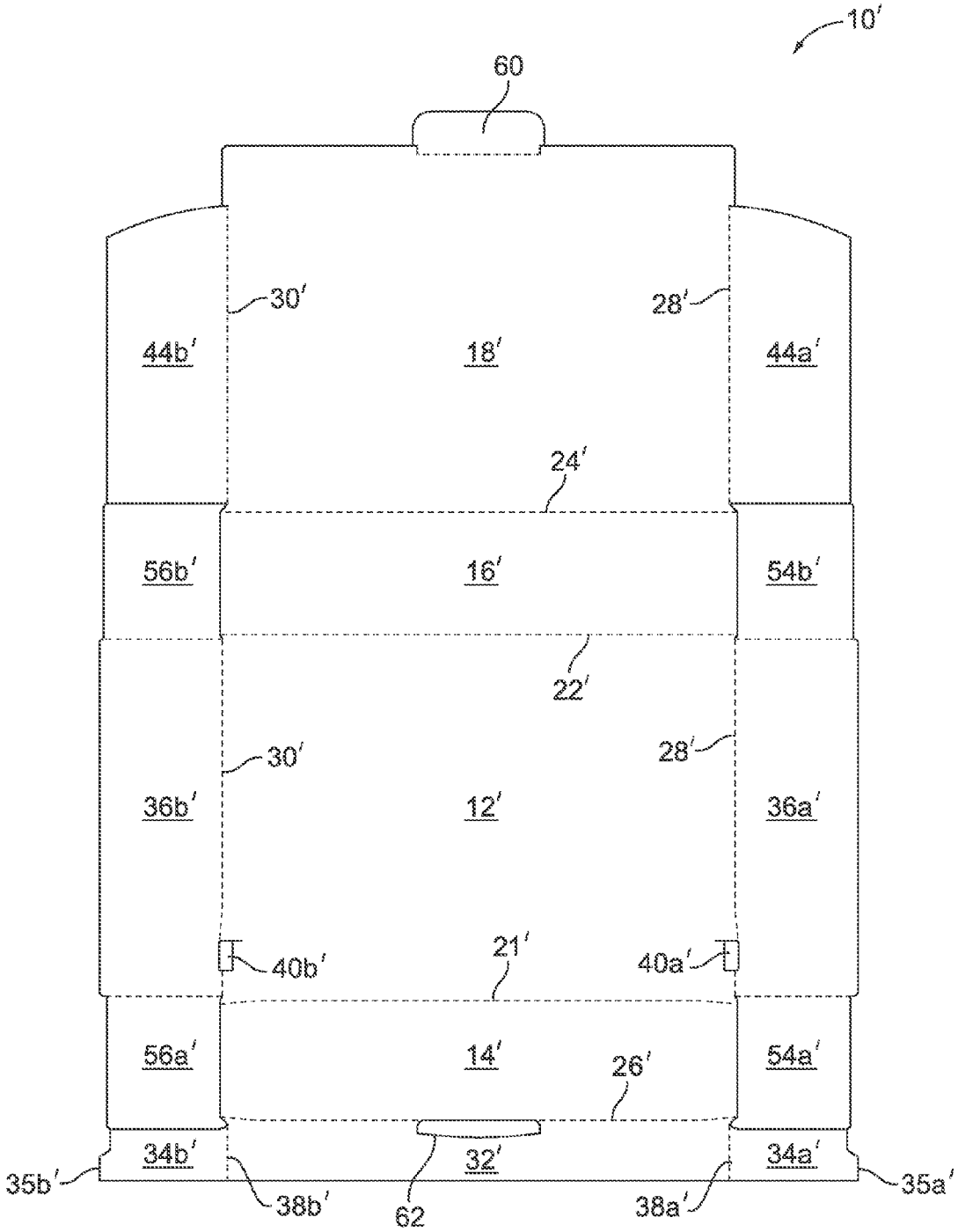
FIGS. 4 and 5 are the respective plan view and top perspective view of a cut and scored paperboard blank for forming a hammer-lock container depicted in FIGS. 6A-6E in accordance to a second embodiment of the present invention.
Figure 5:
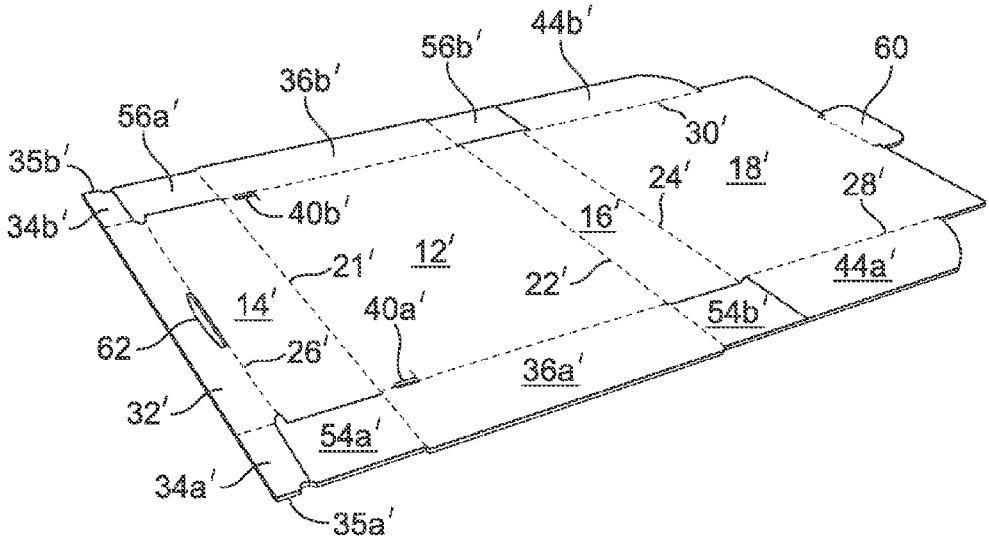
Figure 6A:
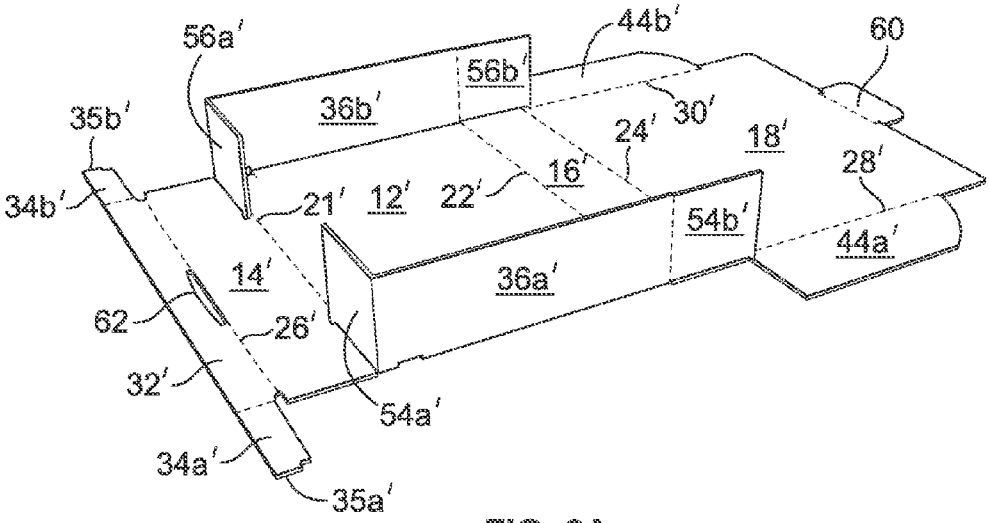
FIGS. 6A-6E illustrate the folding sequences of the blank shown in FIG. 5 for constructing the hammer-lock container in accordance to the second embodiment of the present invention.
Figure 6B:
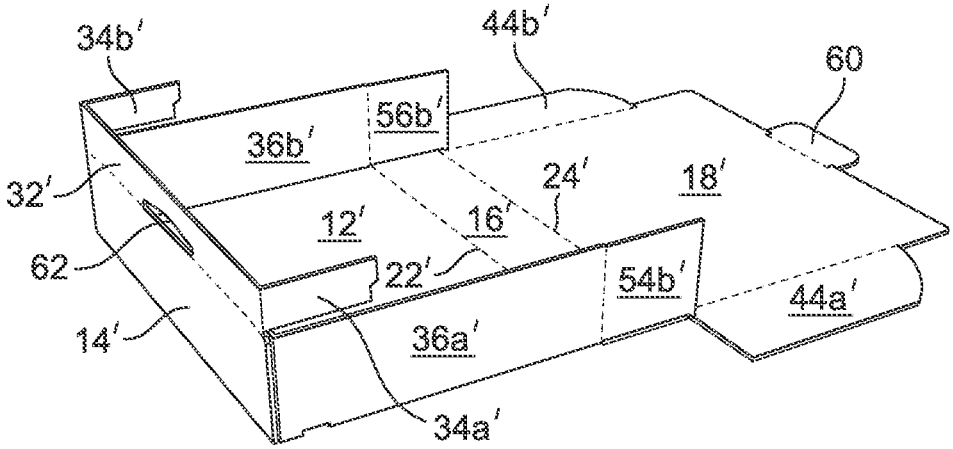
Figure 6C:
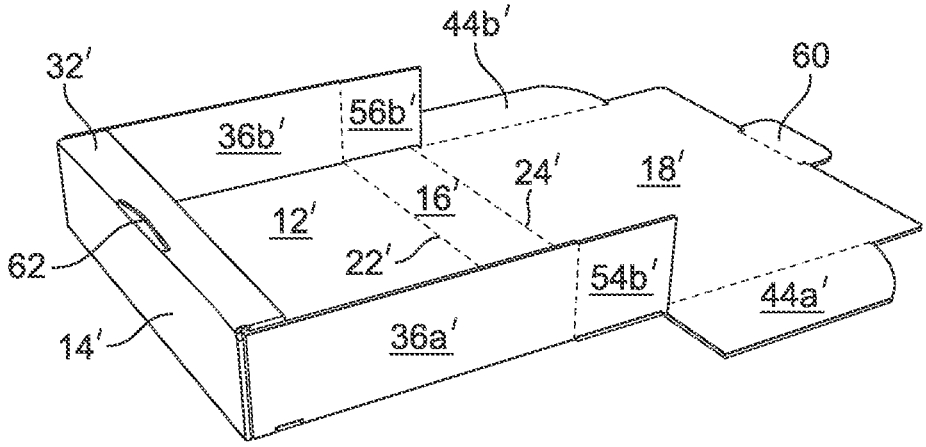
Figure 6D:
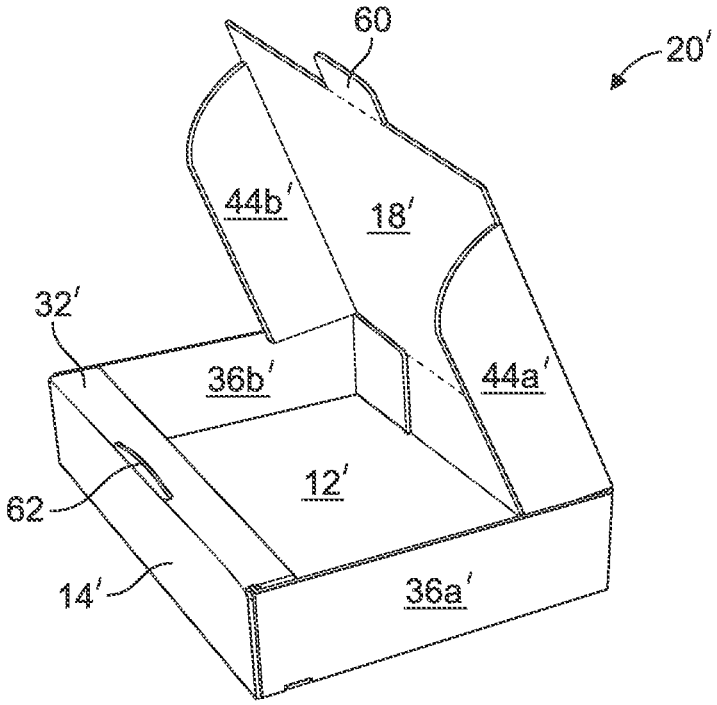
Figure 6E:
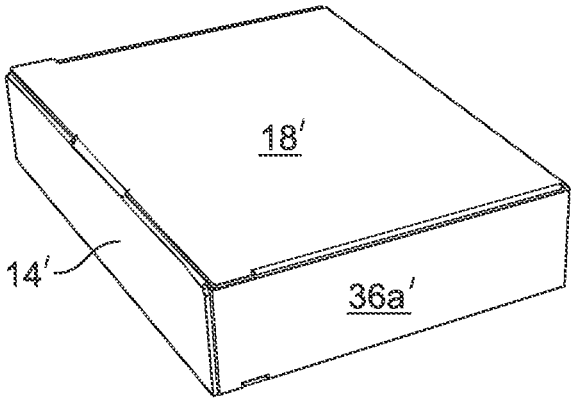

FIGS. 4 and 5 are the respective plan view and top perspective views of a cut and scored paperboard blank for forming a hammer-lock container 20' depicted in FIGS. 6A-6E in accordance to a second embodiment of the present invention. It should be noted that the second embodiment is very similar to the first embodiment, except that the dust flaps 44*a*', 44*b*' in the second embodiment does not have the dust flap locking tabs 48*a*, 48*b* and the third and fourth slots 42*a*, 42*b* as depicted in the figures of the first embodiment. However, the second embodiment has two features, as shown in FIG. 4, that includes a fifth locking tab 60 and a fifth slot 62 which engage with one another to enclose the hammer-lock container 20'. The blank 10' is substantially flat symmetrical with respect to its longitudinal axis thereof. The blank 10' is preferably an integral piece of a material such as continuous sheet of conventional corrugated paperboard. The blank 10' is cut along its outer margins to form its specific shape. The blank 10' is divided into front, bottom, back, and top wall panels by three transverse parallel fold lines 21', 22', and 24'. The blank 10' is also divided by two longitudinal parallel fold lines 28', 30'. The bottom wall panel comprises a front edge, a back edge, and opposite side edges defined by respective transverse and longitudinal fold lines 21, 22, 24, 28, and 30. The front wall panel 14' is defined by fold line 21'. The bottom wall panel 12' is defined by fold lines 21', 22'. The back wall panel 16' is defined by fold lines 22', 24' and the top wall panel 18' is defined by fold line 24'. The front wall panel 14' includes a shoulder panel 32' defined by fold line 26'.

A front wall panel 14' comprises a front edge, a back edge, and opposite side edges in which the back edge of the front wall is foldably joined to the bottom wall panel. The first shoulder panel 32' further includes first and second hammer-lock flaps 34*a*', 34*b*' defined by two respective fold lines 38*a*', 38*b*' and extended from the lateral side of the first shoulder panel 32'. Each of the first and second hammer-lock flap 34*a*', 34*b*' includes a respective first and second locking tab 35*a*' and 35*b*'. The first shoulder panel 32' also includes a fifth slot 62 formed in proximity of mid-portion and adjacent to the front wall to receive the fifth locking tab of the top wall thereof which engages with the tab 60 that extend from the free edge of the top wall panel to securely enclose the hammer-lock container 20'. The two side wall panels 36*a*', 36*b*' are defined by respective fold lines 28', 30*b*' and integrally extend from the lateral side of the bottom wall panel 12'. Side wall panels 36*a*', 36*b*' each includes corresponding first and second flanges 54*a*', 54*b*', third and fourth flanges 56*a*', 56*b*' extend from the respective lateral sides by corresponding fold lines 52*a*', 52*b*' and 55*a*', 55*b*'. The bottom wall panel 12' includes first and second slots 40*a*', 40*b*' and third and fourth slots 42*a*', 42*b*' formed on the lateral side. The top wall panel 18' includes two identical dust flaps 44*a*', 44*b*' defined by fold lines 28' and 30'. In the folded position, the first and second locking tabs 35*a*', 35*b*' are inserted into the respective first and second slots 40*a*', 40*b*'.

FIGS. 6A-6E illustrate the folding sequences of the blank 10" shown in FIG. 5 for constructing the hammer-lock container 20' in accordance to the third embodiment of the present invention. It should be noted that the proper size and configuration of these panels are important to construct into front, bottom, back, and top wall panels that are brought into juxtaposition with one another to form the hammer-lock container 20'. Since the folding sequence of blank 10" is substantially the same as the first and second embodiments, then it is not repeated herein to avoid redundancy.

Figure 7:
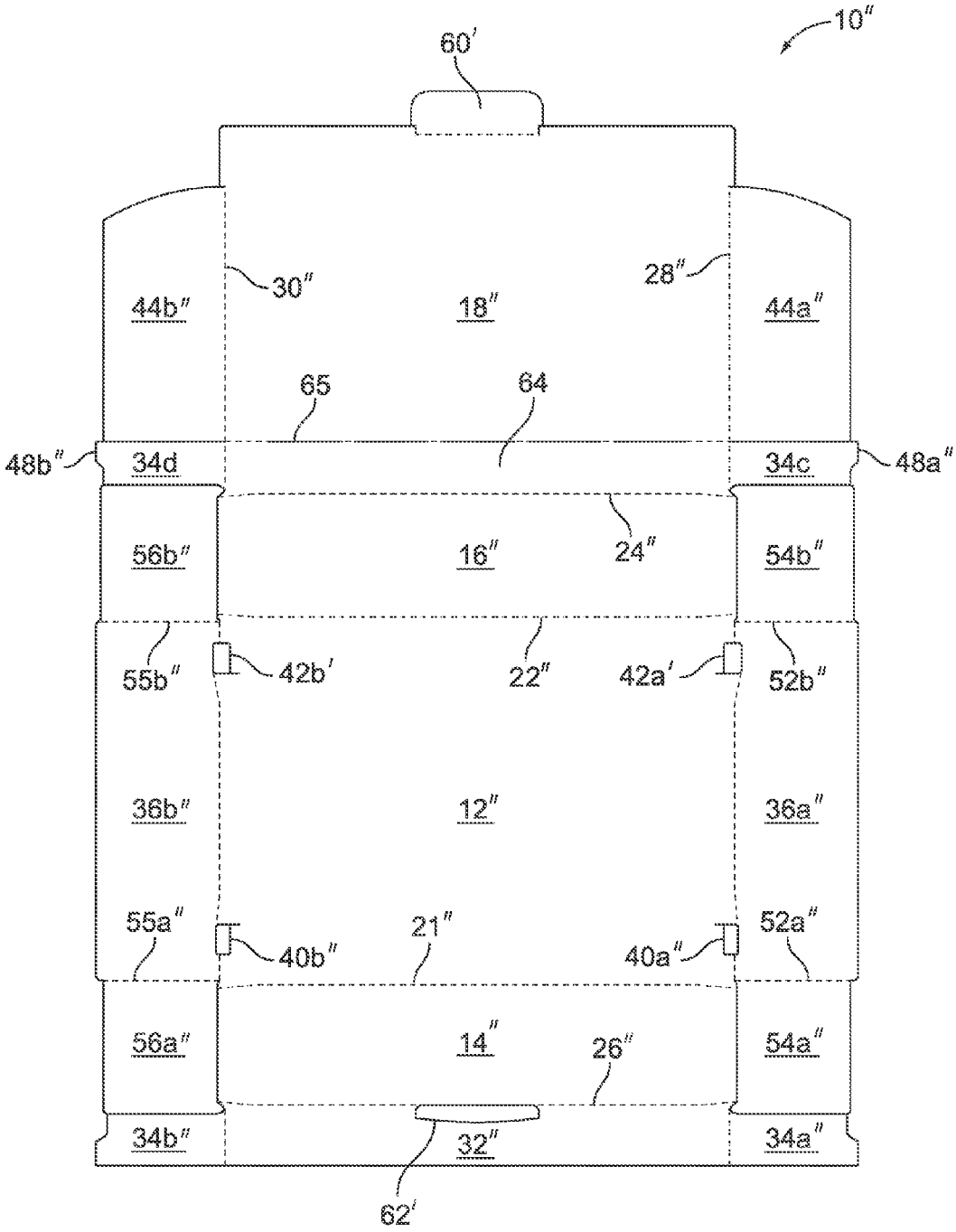
FIGS. 7 and 8 are the respective plan view and top perspective view of a cut and scored paperboard blank for forming a hammer-lock container depicted in FIGS. 9A-9F in accordance to a third embodiment of the present invention.
Figure 8:
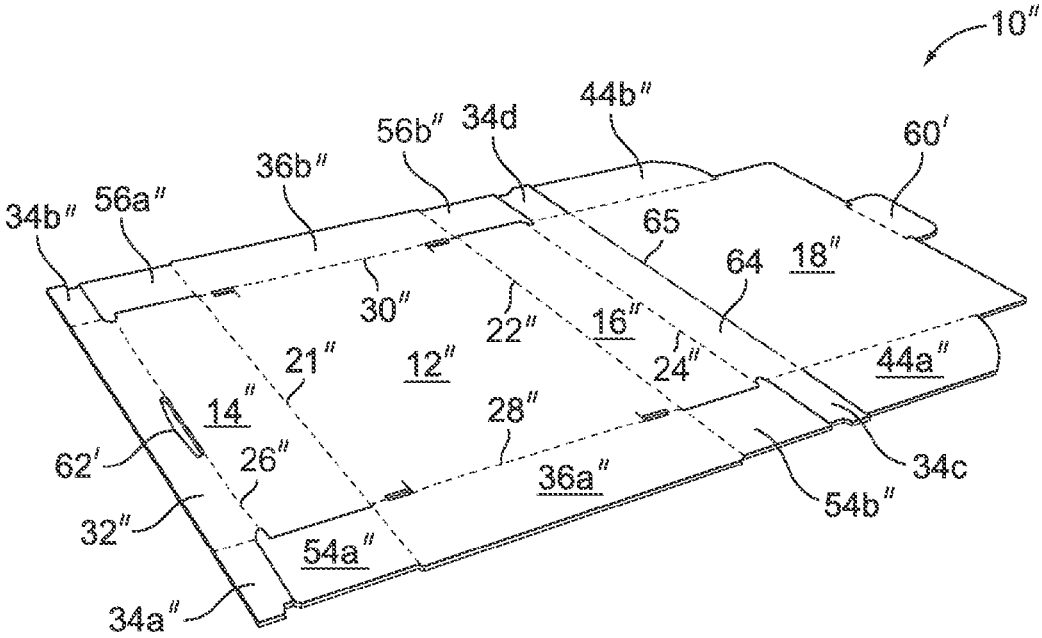
Figure 9A:
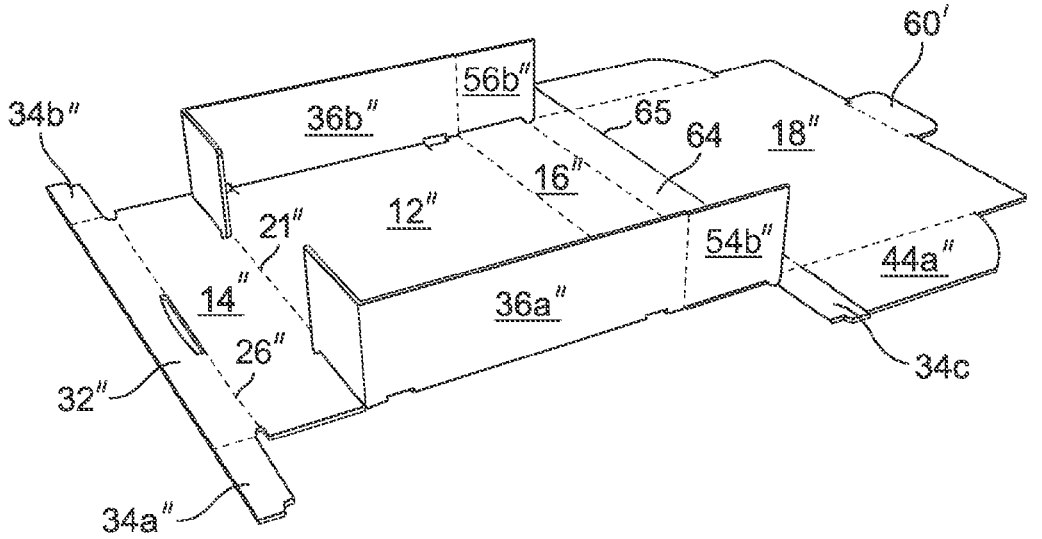
FIGS. 9A-9F illustrate the folding sequences of the blank shown in FIG. 8 for constructing the hammer-lock container in accordance to the third embodiment of the present invention.
Figure 9B:
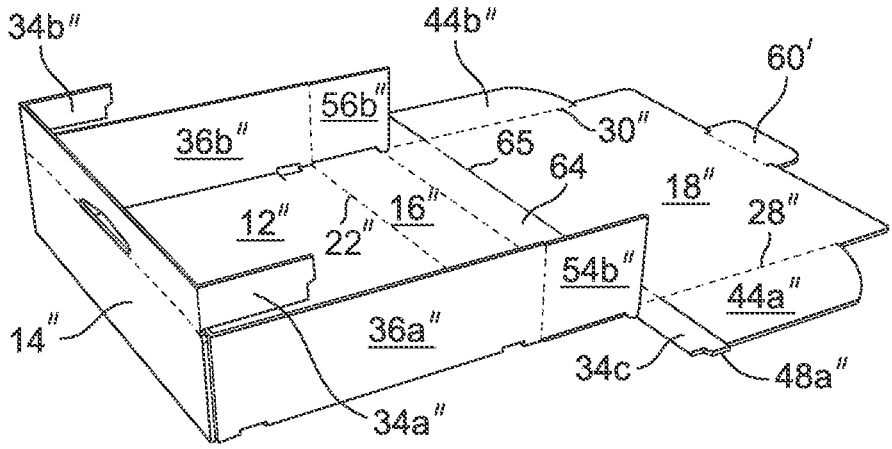
Figure 9C:
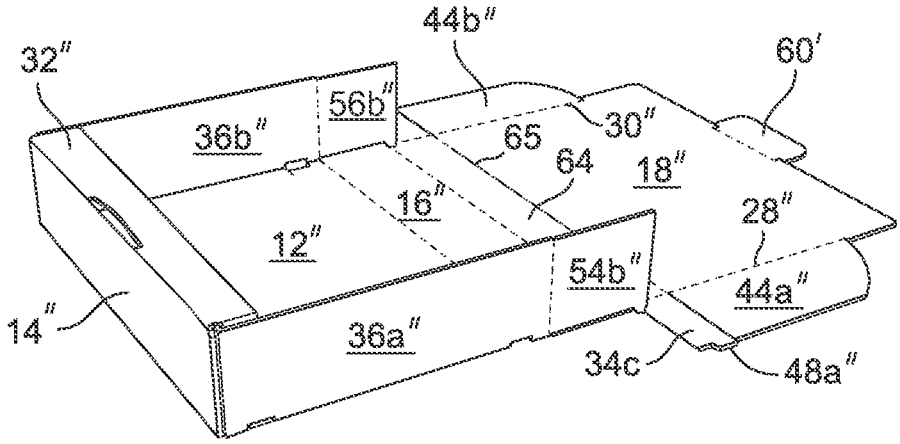
Figure 9D:
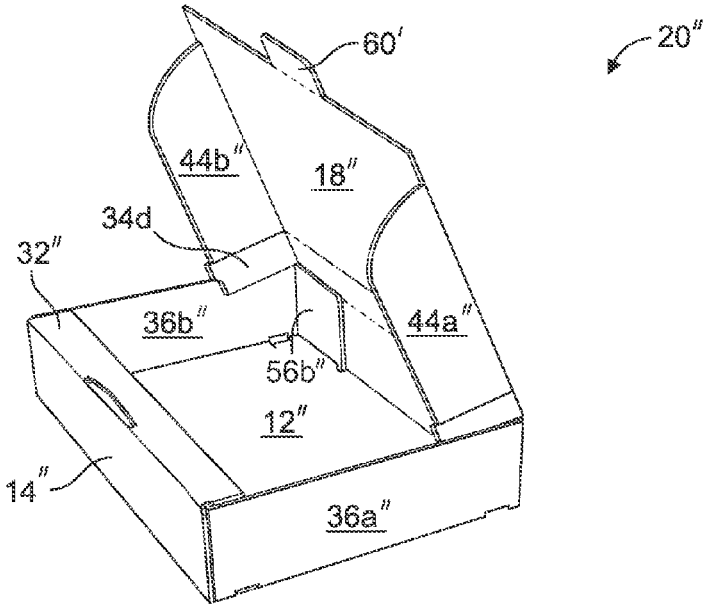
Figure 9E:
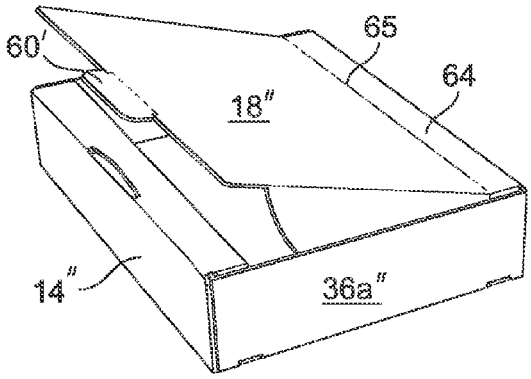
Figure 9F:
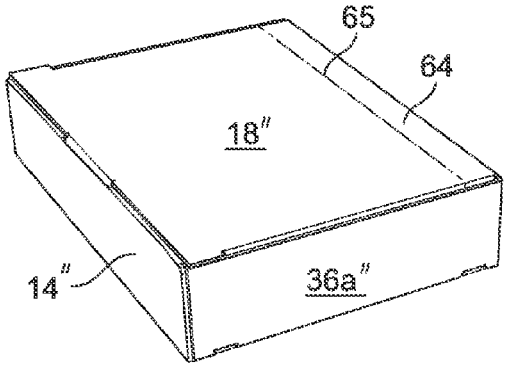

FIGS. 7 and 8 are the respective plan view and top perspective view of a cut and scored paperboard blank 10" for forming a hammer-lock container 20" depicted in FIGS. 9A-9F in accordance to a third embodiment of the present invention. It should be noted that the third embodiment is very similar to the first and second embodiments, except that in the third embodiment, the top wall panel 18" includes a second shoulder panel 64 defined by fold line 65. the second shoulder panel 64 is foldably joined to longitudinal edge of the back wall panel 16". The second shoulder panel 64 includes respective third and fourth hammer-lock flaps 34*c*, 34*d* each of which is foldably joined from opposed lateral edges thereof. Each of the third and fourth hammer-lock flaps 34*c*, 34*d* includes respective third and fourth locking tabs 48*a*", 48*b*" each of which extends outwardly from respective free edges thereof and is inserted into the corresponding third and fourth slots on the bottom wall. Those panels in the third embodiment that are identified as prime or double prime are not described again since they are the same as the first and second embodiments. In fact, the second shoulder panel 64 is substantially mirror image of the first shoulder panel 32" formed between the back wall panel 16", and top wall panel 18". The third and fourth hammer-lock flaps 34*c*, 34*d* are foldably attached to the second shoulder panel 64 and are engaged with the third and fourth slots 42*a*', 42*b*'. The third and fourth hammer-lock flaps 34*c*, 34*d* permit the top portion of the container securely attached to the bottom portion while the top wall panel 18" is free from any impediments in opening or closing the hammer-lock container. The fifth locking tab 60' and fifth slot 62' are engaged with one another to enclose the hammer-lock container 20" in accordance to the third embodiment of the invention.

Referring to FIGS. 9A-9F, manual set-up of the hammer-lock container 20" is easily accomplished. However, one of ordinary skill in the art would appreciate that generally a folding machine alternatively performs the forming operations. The blank 10" is laid horizontally so that the side wall panels 36*a*", 36*b*" are folded upright along respective fold lines 28" and 30" and to form the side walls. Next, the two flanges 54*a*" and 56*a*" are folded toward one another at right angles with respect to the fold lines 52*a*" and 55*a*", respectively. Next, front wall panel 14" is folded upright with respect to fold line 20" and the first and second hammer-lock flaps 34*a*", 34*b*" are folded at right angle in an embracing manner and pushed downwardly so that the first and second locking tabs 35*a*", 35*b*" are securely inserted into corresponding first and second slots 40*a*", 40*b*". It should be noted that the first shoulder panel 32" defines a landing and covers a portion of the bottom wall 12" when the first and second hammer-lock flaps 34*a*", 34*b*" are in folded position. The landing provides significant strength to the hammer-lock container when these containers are stacked up on one another. Next, the second shoulder panel 64 is folded upright along the fold line 24" while the third and fourth hammer-lock flaps 34*c*, 34*d* are inserted into the corresponding third and fourth slots 42*a*', 42*b*'. It should be noted that in this embodiment of the invention, the third and fourth hammer-lock flaps 34*c*, 34*d* are not attached to the dust flaps 44*a*", 44*b*" and thus their movement is independent from the dust flaps. Next, the dust panels 44*a*", 44*b*" are folded uprightly along the respective fold lines 28", 30" as the top wall panel 18" encloses the hammer-lock container 20" and the third and fourth hammer-lock tabs 48*a*", 48*b*" are inserted into the third and fourth slot 42*a*", 42*b*". Finally, the fifth locking tab 60' is inserted into the fifth slot 62' to completely enclose the hammer-lock container 20". In use, the hammer-lock container 20 may contain variety of products, but not limited to, such as hamburger patties, electronic devices, condiments and/or produce since the container 20 has superior stackability when compared to prior art containers for similar goods and/or functions.

Figure 10:
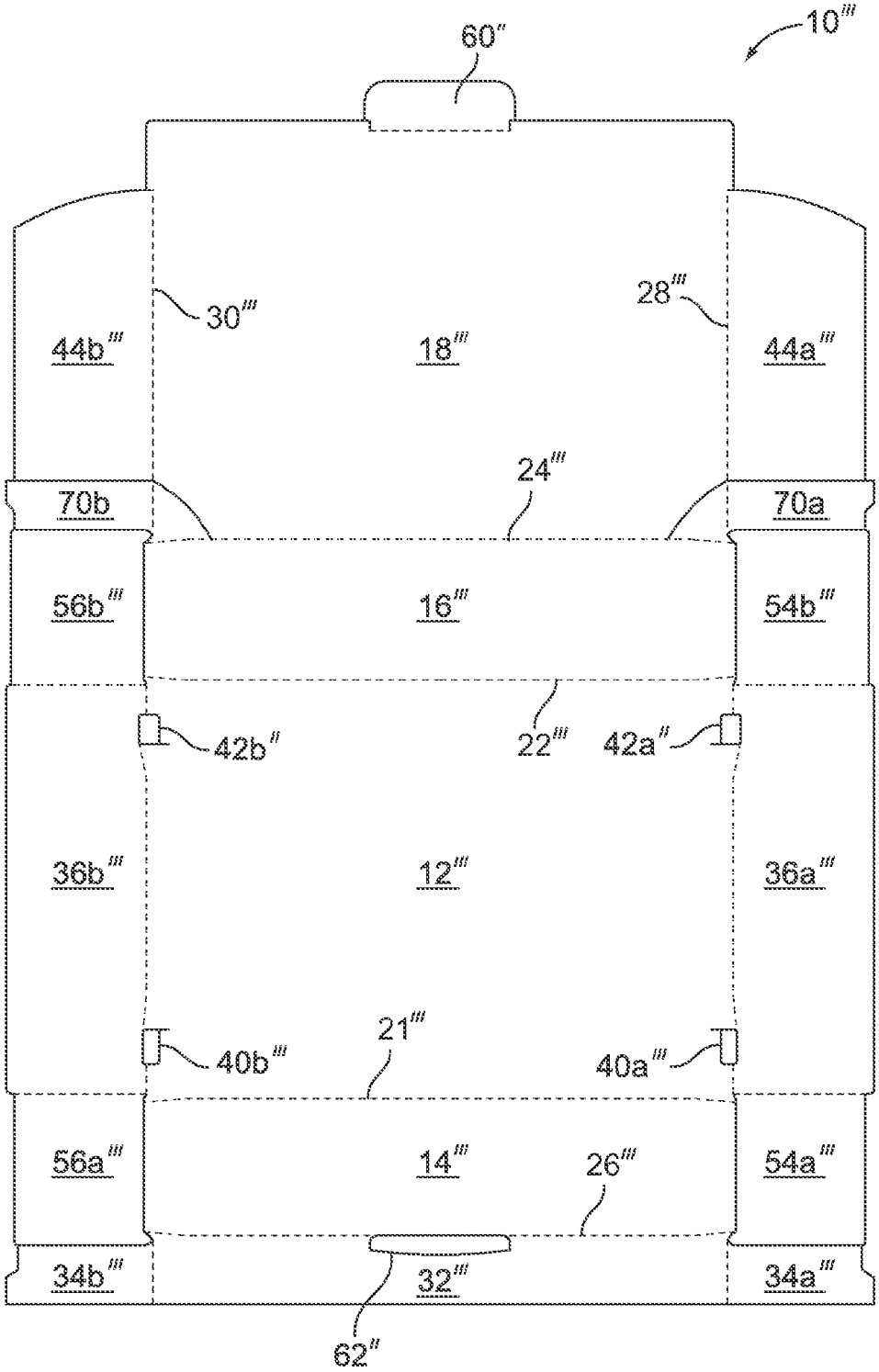
FIGS. 10 and 11 are the respective plan view and top perspective view of a cut and scored paperboard blank for forming a hammer-lock container depicted in FIGS. 12A-12E in accordance to a fourth embodiment of the present invention.
Figure 11:
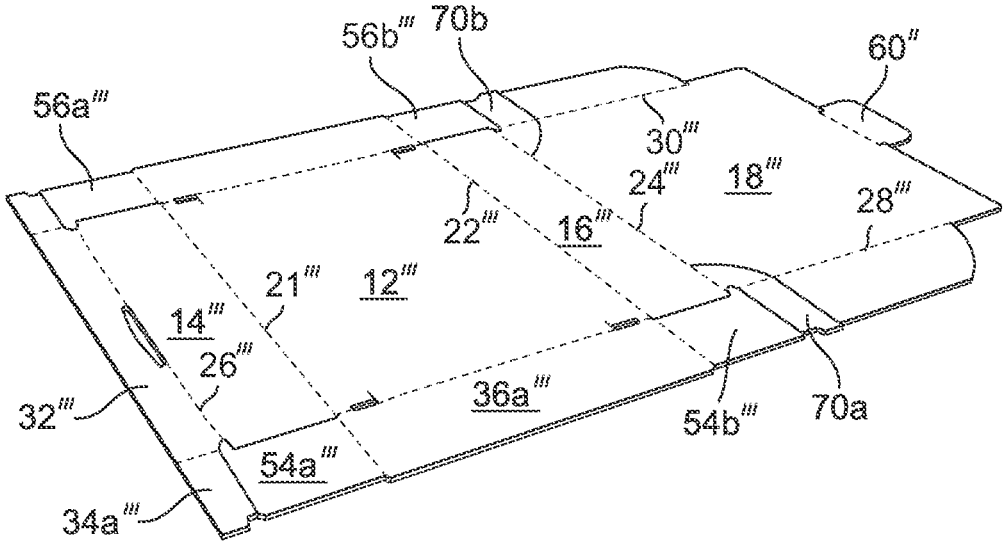
Figure 12A:
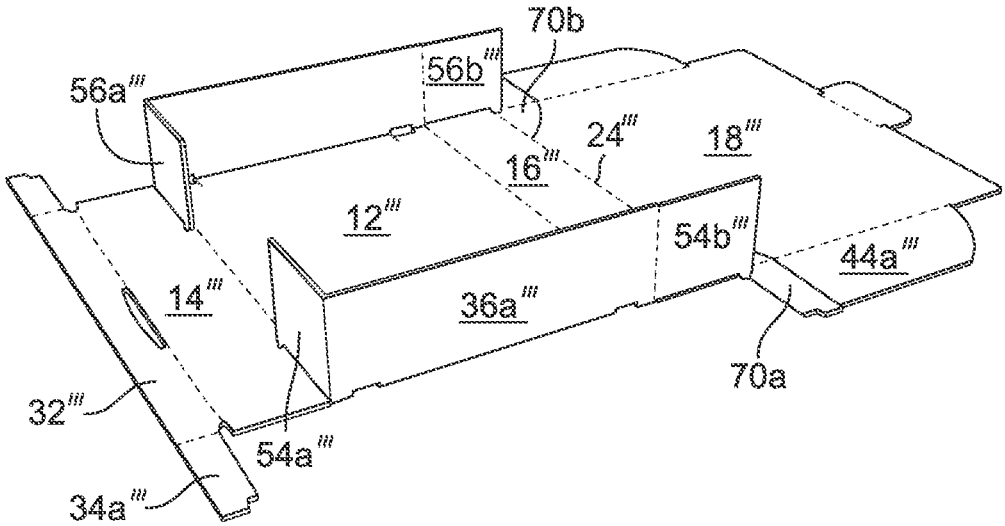
FIGS. 12A-12E illustrate the folding sequences of the blank shown in FIG. 11 for constructing the hammer-lock container in accordance to the fourth embodiment of the present invention.
Figure 12B:
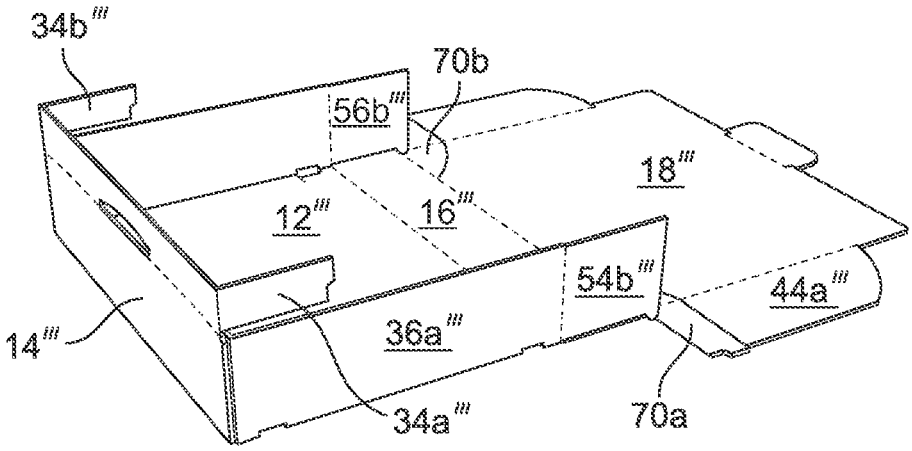
Figure 12C:
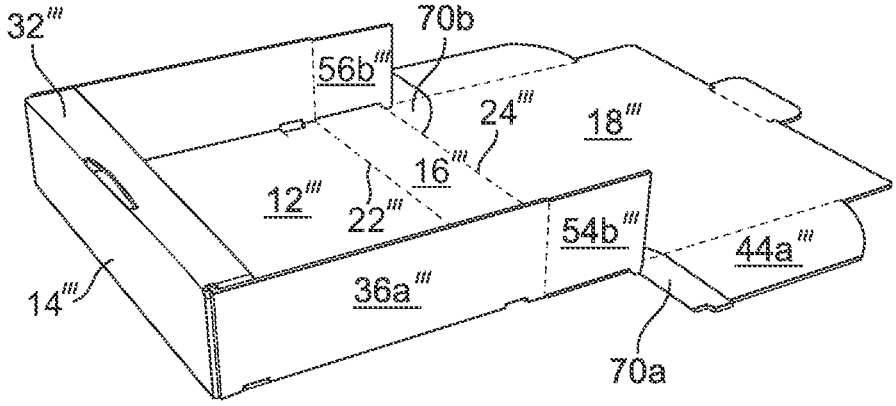
Figure 12D:
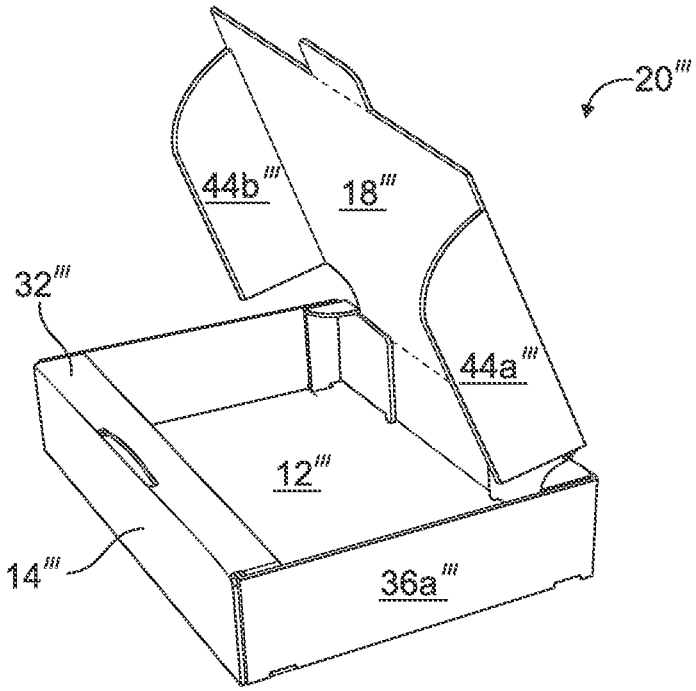
Figure 12E:
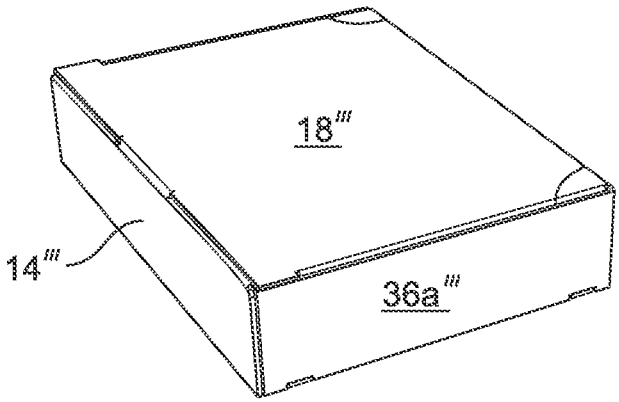

FIGS. 10 and 11 are the respective plan view and top perspective view of a cut and scored paperboard blank 10'" for forming a hammer-lock container 20'" depicted in FIGS. 12A-12E in accordance to a fourth embodiment of the present invention. The blank 10'" in FIGS. 10, 11 are substantially the same as blank 10" in FIGS. 7 and 8, except that the third and fourth hammer-lock flaps 70*a*, 70*b* are integrally attached to the back panel 16'" so that their movements are independent from both the dust flap 44*a*'", 44*b*'" and the top wall panel 18'". Since the fourth embodiment is substantially the same as third embodiment, the details of FIGS. 10 and 11 will be repeated herein to avoid redundancy.

Referring to FIGS. 12A-12E, manual set-up of the hammer-lock container 20'" is easily accomplished. However, one of ordinary skill in the art would appreciate that generally a folding machine alternatively performs the forming operations. The folding sequence of paperboard blank 10'" for forming a hammer-lock container 20'" as depicted in FIGS. 12A-12E is otherwise the same as the third embodiment of the invention and will not be repeated to avoid redundancy.

Figure 13:
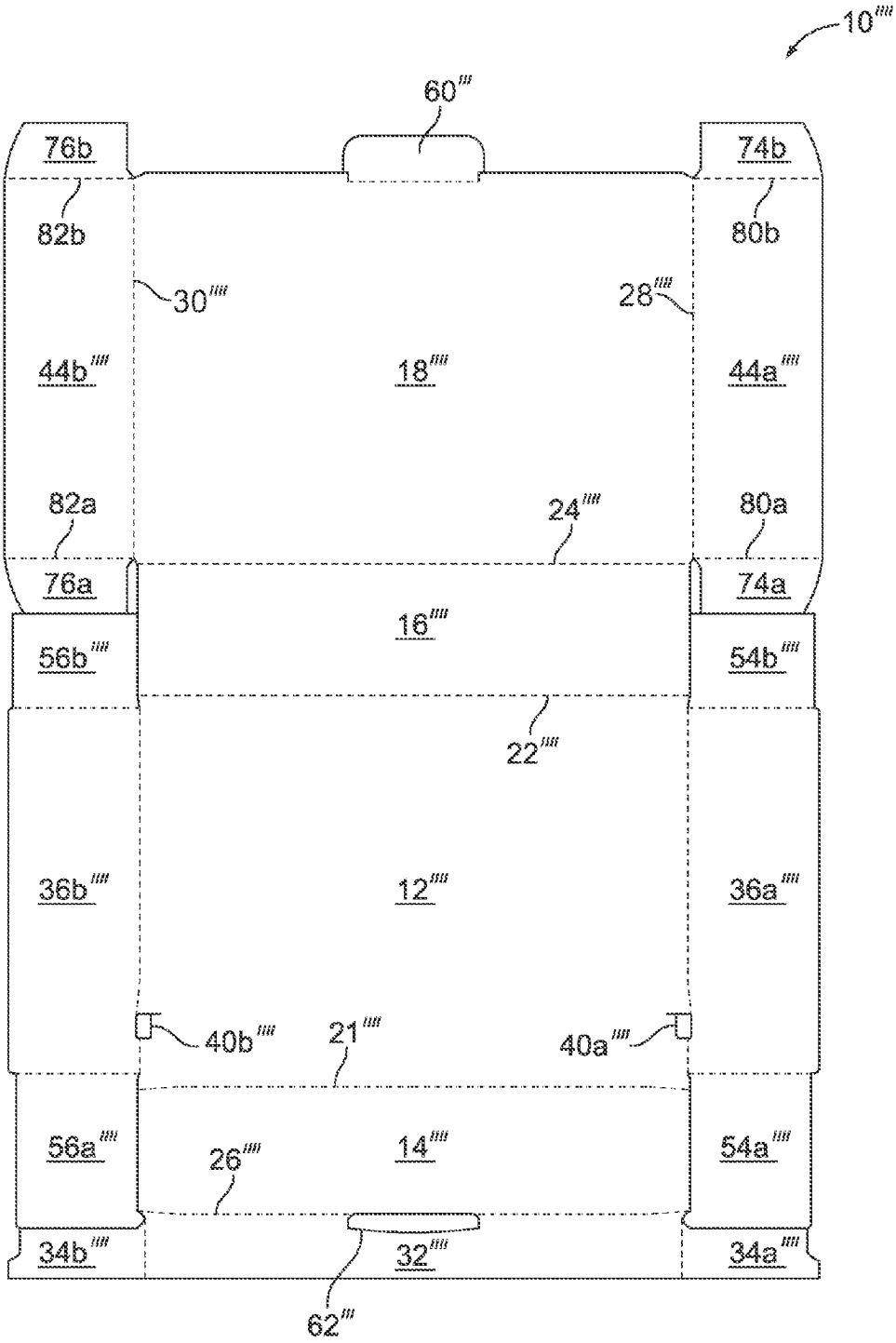
FIGS. 13 and 14 are the respective plan view and top perspective view of a cut and scored paperboard blank for forming a hammer-lock container depicted in FIGS. 15A-15F in accordance to a fifth embodiment of the present invention.
Figure 14:
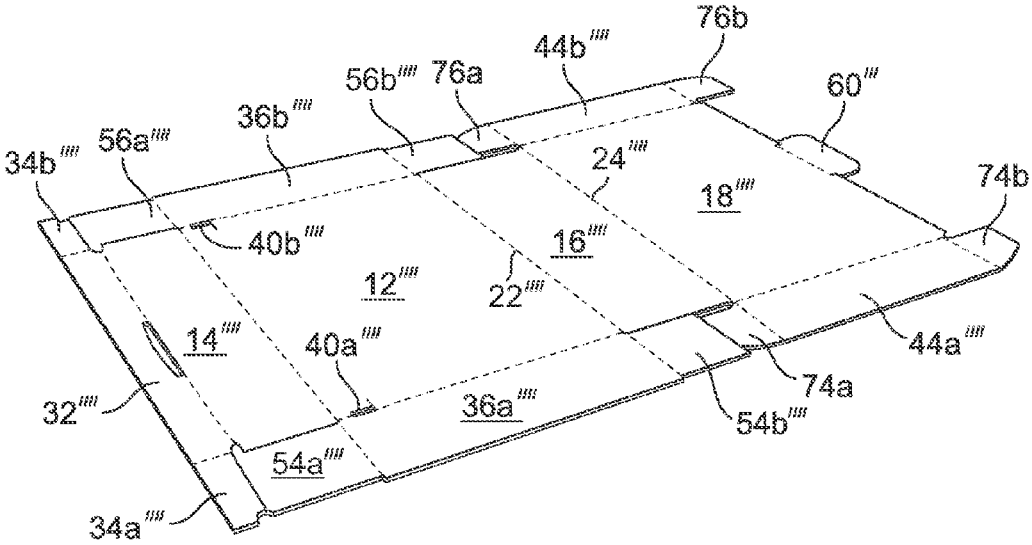
Figure 15A:
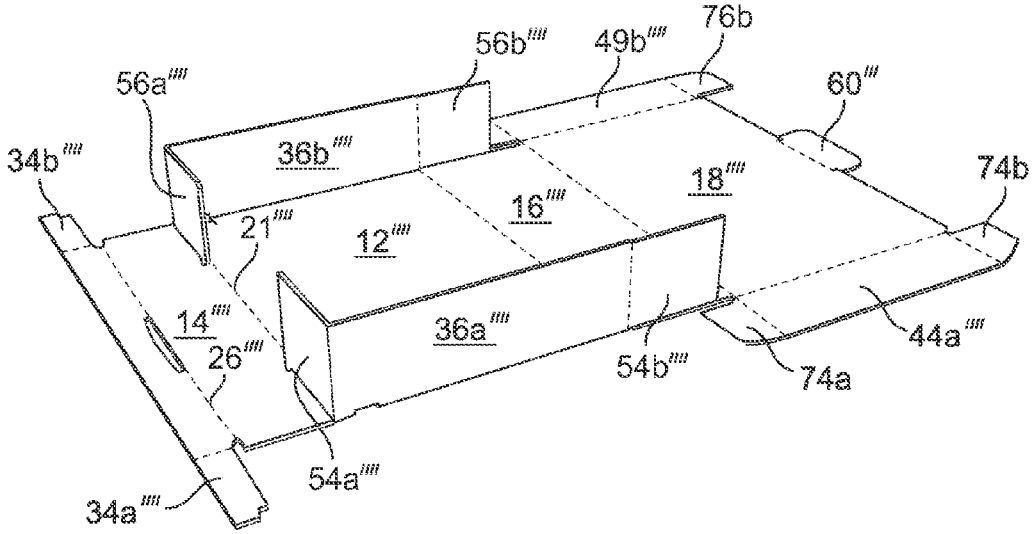
FIGS. 15A-15F illustrate the folding sequences of the blank shown in FIG. 14 for constructing the hammer-lock container in accordance to the fifth embodiment of the present invention.
Figure 15B:
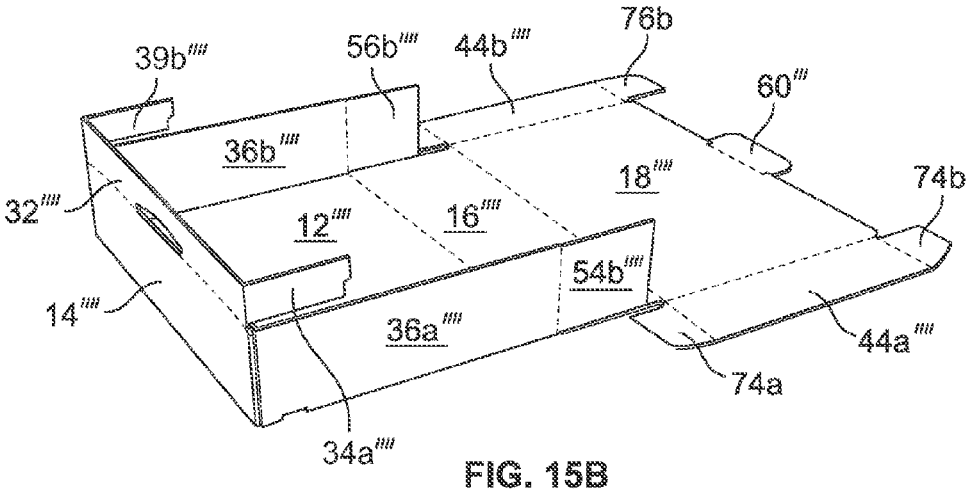
Figure 15C:
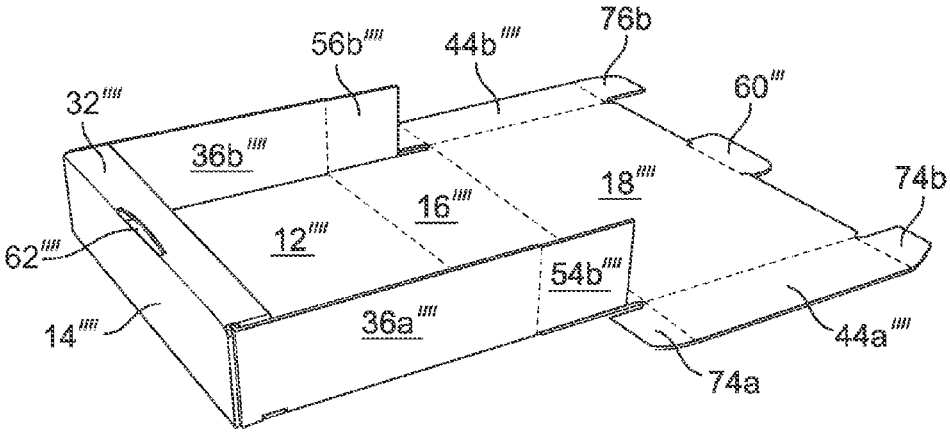
Figure 15D:
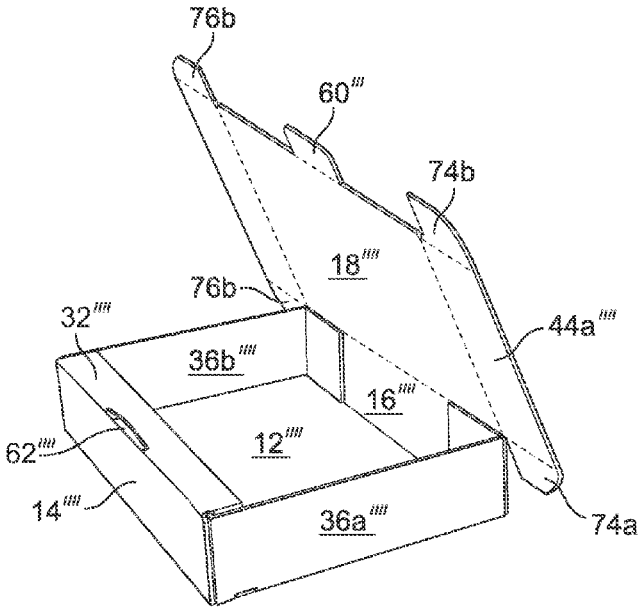
Figures 15E, 15F:
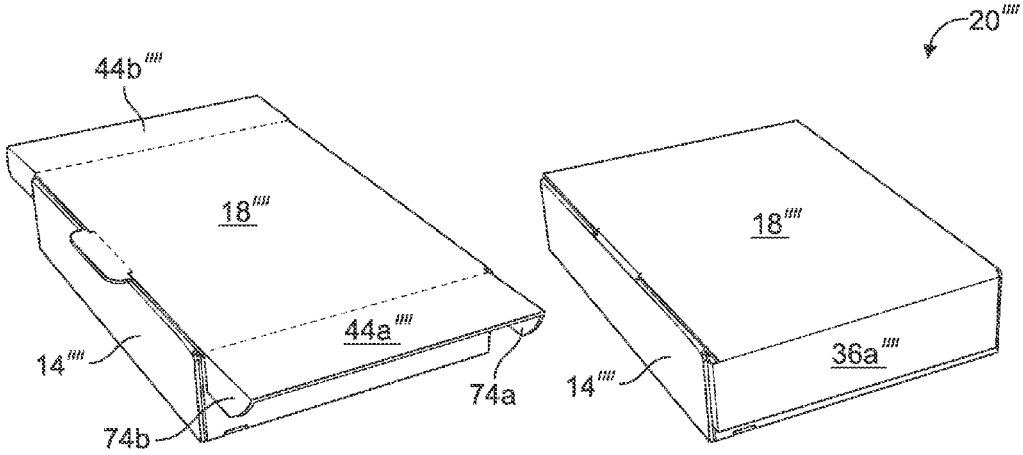

FIGS. 13 and 14 are the respective plan view and top perspective view of a cut and scored paperboard blank 10"" for forming a hammer-lock container 20"" depicted in FIGS. 15A-15E in accordance to a fifth embodiment of the present invention. It should be noted that the fifth embodiment is quite similar to the second embodiment, except that each of the respective dust flaps 44*a*"", 44*b*"" in the fifth embodiment includes a pair of respective ear flaps 74*a*, 74*b* and 76*a*, 76*b* that are used to bring the back wall panel 16"" and the top wall panel 18"" into juxtaposition with the front and bottom wall panels 14"" and 12"", respectively. The ear flaps 74*a*, 74*b* and 76*a*, 76*b* extend from the lateral side of the respective dust flap 44*a*"", 44*b*"" and are defined by respective fold lines 80*a*, 80*b* and 82*a*, 82*b*. Those panels in the third embodiment that are identified as prime or double prime are not described again hereinafter since they are the same as the second embodiment. It should be noted that the proper size and configuration of these panels are important to construct into front, bottom, back, and top wall panels that are brought into juxtaposition with one another to form the hammer-lock container 20"".

FIGS. 15A-15F illustrate the folding sequences of the blank 10"" shown in FIG. 14 for constructing the hammer-lock container 20"" in accordance to the fifth embodiment of the present invention. It should be noted that the proper size and configuration of these panels are important to construct into front, bottom, back, and top wall panels that are brought into juxtaposition with one another to form the hammer-lock container 20"". Since the folding sequence of blank 10"" is substantially the same as the second embodiment, then it is not repeated herein to avoid redundancy.

It should now be appreciated that the present invention provides a material-saving, quickly erected carton especially useful in retaining, transporting variety of products such as hamburger patties, electronic devices, condiments, by way of example. The hammer-lock containers 20, 20', 20''' and 20"" are designed with hammer-lock flaps having a locking tab engaged with a slot in the bottom of the container. As described above, the structure of the rear panels, the side panels, the front panels, base portion panel, and top portion panel enhance the rigidity, stackability, venting capability and manufacturing cost effectiveness of the hammer-lock container. The blank used to form the hammer-lock container has a symmetrical design, which reduces erecting and closing labor. The lay flat design of the blank speeds the cutting and packaging process and facilitates easy shelving.

Numerous modifications and variations on the present invention are possible in light of the above teachings. It is, therefore, to be understood that within the scope of the accompanying claims, the invention may be practiced otherwise than as specifically described herein.

It should be understood that fold lines and score line as used herein may be used interchangeably so long as the function of the line is not destroyed. It should also be understood that prime, double prime, triple prime, and quadric prime are used to characterize the same elements in the drawings.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A container formed from a one-piece unitary blank of material, comprising a bottom wall foldably joined to upstanding opposed parallel side walls, a back wall, and a front wall, a top wall foldably joined to the back wall, wherein the top wall comprises a pair of opposed dust flaps each of which foldably joined to respective lateral edges of the top wall, the bottom wall comprises first and second slots each of which formed on opposed lateral edges in proximity of the front wall and respective third and fourth slots each of which formed on the opposed lateral edges in proximity of the back wall, each of the first, second, third, and fourth slots includes a respective cut extension and a respective kink being extended from each of the first, second, third, and fourth slots, a first shoulder panel foldably joined to a longitudinal edge of the front wall, the first shoulder panel includes respective first and second hammer-lock flaps each of which foldably joined from opposed lateral edges thereof and wherein the respective first and second hammer-lock flaps includes respective first and second locking tabs extending outwardly from respective free edges thereof and being inserted into the corresponding first and second slots on the bottom wall and wherein each of the dust flaps further includes a pair of dust flap locking tabs each of which extending outwardly from respective edges thereof and wherein each of the dust locking tabs is inserted into the respective third and fourth slots and wherein a longitudinal free edge of the top wall fully extends to abut a longitudinal free edge of the first shoulder panel when the container is in a closed position.

2. The container of claim 1 wherein each of the dust flaps further includes a pair of ear flaps that are configured to bring the back and top walls into juxtaposition with the front and bottom walls, respectfully.

3. The container of claim 1 wherein the top wall further comprises a fifth locking tab extending outwardly from free edge thereof.

4. The container of claim 1 wherein the first shoulder panel further includes a fifth slot formed adjacent to the front wall to receive the fifth locking tab of the top wall.

5. The container of claim 1 further comprising a second shoulder panel foldably joined to a longitudinal edge of the back wall, the second shoulder panel includes respective third and fourth hammer-lock flaps each of which foldably joined from opposed lateral edges thereof and wherein each of the third and fourth hammer-lock flaps includes respective third and fourth locking tabs each of which extends outwardly from respective free edges thereof and being inserted into the respective third and fourth slots on the bottom wall.

6. The container of claim 5 wherein each of the third and fourth hammer-lock flaps is foldably joined to a corner of the longitudinal edge of the back wall.

7. A container formed from a one-piece unitary blank of material used for shipping one or more articles, the container comprising a bottom wall, a front wall, a back wall, and opposite side walls foldaby joined to one another to form a shallow tray, a top wall foldably joined to the back wall, wherein the top wall comprises a pair of opposed dust flaps each of which foldably joined to respective lateral edges of the top wall, the bottom wall comprises first and second slots each of which formed on opposed lateral edges in proximity of the front wall and respective third and fourth slots each of which formed on the opposed lateral edges in proximity of the back wall, each of the first, second, third, and fourth slots includes a respective cut extension and a respective kink being extended from each of the first, second, third, and fourth slots, a first shoulder panel foldably joined to a longitudinal edge of the front wall, the first shoulder panel comprises respective first and second hammer-lock flaps each of which foldably joined from opposed lateral edges thereof and wherein the respective first and second hammer-lock flaps includes respective first and second locking tabs extending outwardly from respective free edges thereof and being inserted into the corresponding first and second slots on the bottom wall and wherein a longitudinal free edge of the top wall fully extends to abut a longitudinal free edge of the first shoulder panel when the container is in a closed position.

8. The container of claim 7 wherein each of the dust flaps further includes a pair of dust flap locking tabs each of which extending outwardly from respective edges thereof and wherein each of the dust locking tabs is inserted into the respective third and fourth slots.

9. The container of claim 7 further comprising a second shoulder panel foldably joined to a longitudinal edge of the back wall panel, the second shoulder panel includes respective third and fourth hammer-lock flaps each of which foldably joined from opposed lateral edges thereof and wherein each of the respective third and fourth hammer-lock flaps includes respective third and fourth locking tabs extending outwardly from respective free edges thereof and being inserted into the respective third and fourth slots on the bottom wall.

10. A one-piece unitary blank for making a container used for shipping one or more articles, the blank comprising a bottom wall panel having a front edge, a back edge, and opposite side edges defined by respective transverse and longitudinal fold lines, the bottom wall panel comprises at least first and second slots each of which formed on opposed side edges and respective third and fourth slots each of which formed on the opposed lateral edges in proximity of the back wall, each of the first, second, third, and fourth slots includes a respective cut extension and a respective kink being extended from each of the first, second, third, and fourth slots; a top wall panel having a front edge wherein the top wall panel comprises a pair of opposed dust flaps each of which foldably joined to respective lateral edges of the top wall, a back edge, and opposite side edges defined by respective transverse and longitudinal fold lines; a back wall panel foldably joined between the back edges of the bottom wall panel and the top wall panel; a front wall panel having a front edge, a back edge, and opposite side edges wherein the back edge of the front wall foldably joined to the bottom wall panel; a first shoulder panel foldably joined to the front edge of the front wall, the first shoulder panel comprises respective first and second hammer-lock flaps each of which foldably joined from opposed lateral edges thereof and configured to be inserted into the respective first and second slots when the blank is folded for making the container and wherein each of the dust flap panels further includes a pair of dust flap locking tabs each of which extending outwardly from respective edges thereof and wherein each of the dust locking tabs is inserted into the respective third and fourth slots and wherein the top wall panel fully extends to a longitudinal edge of the first shoulder panel when the container is constructed.

11. The blank of claim 10 further comprising a second shoulder panel foldably joined to a longitudinal edge of the back wall, the second shoulder panel includes respective third and fourth hammer-lock flaps each of which foldably joined from opposed lateral edges thereof and wherein the respective third and fourth hammer-lock flaps includes respective third and fourth locking tabs extending outwardly from respective free edges thereof and being inserted into the respective third and fourth slots on the bottom wall panel.

* * * * *